US007666046B2

(12) United States Patent
Larochelle

(10) Patent No.: US 7,666,046 B2
(45) Date of Patent: Feb. 23, 2010

(54) RESCUE WATER CRAFT

(75) Inventor: Luc Larochelle, Fleurimont (CA)

(73) Assignee: Nautic & Art Inc., Montreal, Quebec (CA)

( * ) Notice: Subject to any disclaimer, the term of this patent is extended or adjusted under 35 U.S.C. 154(b) by 0 days.

(21) Appl. No.: 11/757,013

(22) Filed: Jun. 1, 2007

(65) Prior Publication Data

US 2008/0299850 A1 Dec. 4, 2008

(51) Int. Cl.
*B63B 35/58* (2006.01)

(52) U.S. Cl. ..... 441/40; 441/41

(58) Field of Classification Search ..... 114/26, 114/345; 441/40, 80; 440/40, 41
See application file for complete search history.

(56) References Cited

U.S. PATENT DOCUMENTS

| | | | | |
|---|---|---|---|---|
| 3,711,879 | A | 1/1973 | Siefert | |
| 3,903,822 | A * | 9/1975 | Le Grand et al. | 114/26 |
| 4,990,114 | A | 2/1991 | LeBlanc, Jr. | |
| 5,170,738 | A * | 12/1992 | Patten | 114/345 |
| 5,421,757 | A * | 6/1995 | Basiliere | 441/39 |
| 5,888,111 | A | 3/1999 | Walker | |

* cited by examiner

*Primary Examiner*—Stephen Avila

(57) ABSTRACT

A rescue water craft comprising an elongated closed-loop tubular structure and a floor is described. The tubular structure has a mid portion and two end portions. Both end portions rise upwardly and outwardly from the mid portion at an angle comprised between 70 and 85 degrees. The floor partially runs along the mid portion. The floor is attached to and encircled by the tubular structure. Each of the two end portions defines an opening between the tubular structure and the floor.

11 Claims, 4 Drawing Sheets

RESCUE WATER CRAFT

FIELD OF THE INVENTION

The present invention generally relates to the field of water crafts. More specifically, the invention relates to a water craft suitable for rescue operations.

BACKGROUND OF THE INVENTION

Water surfaces such as lakes or rivers may constitute hazards to humans. This type of hazard is especially frequent when the water surface is frozen, as the looks of the surface may be quite deceiving. Indeed, although it looks safe to circulate on the frozen surface, the ice may break under load, throwing a passer-by in freezing waters. Unfortunately, such situations happen regularly, especially in spring when the ice thaws.

When such situations occur, rescue teams rush on site to help the distressed person. In these cases, specialized equipment is often used. Such equipment may include a rescue water craft comprising an opening to pull the distressed person out of the water. Examples of such type of water crafts having openings are disclosed in U.S. Pat. No. 5,170,738 to Patten and U.S. Pat. No. 5,888,111 to Walker. U.S. Pat. No. 5,170,738 discloses an inflatable water craft having a raised bow and equipped with an opening in the bow circumscribed by an inflatable structure. This water craft is used by scuba divers to more easily pull themselves into the craft. However, the bow of this water craft, not being specifically designed for rescue operations, is too low to permit a floating distressed person to be rescued without pushing its head down in water. U.S. Pat. No. 5,888,111 to Walker describes an inflatable rescue water craft having both a raised bow and stern, each of the bow and stern circumscribing an opening by which a distressed person may be pulled in the water craft. Although this water craft is designed for rescue operations, it is more adapted for rescues in warm weather than rescues in cold weather. Indeed, the openings being of a limited dimension, it is cumbersome to extract from water a distressed person wearing large garments such as a snowmobile suit and sometimes even a helmet. Furthermore, in order to pull the distressed person from water, a rescuer needs to kneel down on a floor of the water craft and pull the distressed person on the floor. This rescuing position requires a large amount of force from the rescuer's arms and back, especially when the distressed person wears thick garments that become heavy with water. This renders the rescue cumbersome and causes a risk of injury to the rescuer. Another disadvantage of this particular water craft is that rescuers need to adopt a seated or kneeled down position when navigating on it, somehow limiting their field of view for searching.

There is therefore a need for an improved rescue water craft that is better adapted for rescuing operations and that provides rescuers with better options of rescuing and searching positions.

SUMMARY OF THE INVENTION

It is an object of the present invention to provide a rescue water craft that overcomes or mitigates one or more disadvantages of known rescue water crafts, or at least provides a useful alternative.

The invention provides the advantages of being well adapted for rescuing operations in cold waters where distressed persons often wear large garments such as a snowmobile suit and a helmet.

The invention also provides the advantage of providing rescuers with options of rescuing positions for pulling a person from water.

The invention also provides the advantage of providing rescuers with an improved searching positions for searching a person in water.

In accordance with an embodiment of the present invention, there is provided a rescue water craft comprising an elongated closed-loop tubular structure and a floor. The tubular structure has a mid portion and two end portions. Both end portions rise upwardly and outwardly from the mid portion at an angle comprised between 70 and 85 degrees. The floor partially runs along the mid portion. The floor is attached to and encircled by the tubular structure. Each of the two end portions defines an opening between the tubular structure and the floor.

BRIEF DESCRIPTION OF DRAWINGS

These and other features of the present invention will become more apparent from the following description in which reference is made to the appended drawings wherein.

DETAILED DESCRIPTION OF THE INVENTION

The rescue water craft of the present invention is used for rescue operation in water, icy waters or on muddy terrain. The water craft is provided with an opening at both the bow and helm for extracting a distressed person from water. A rescuer positions himself so that he is capable of pulling the distressed person out of water from one of the openings and then lays the distressed person on a floor of the water craft, where the rescuer can provide first aid.

Figure 1:
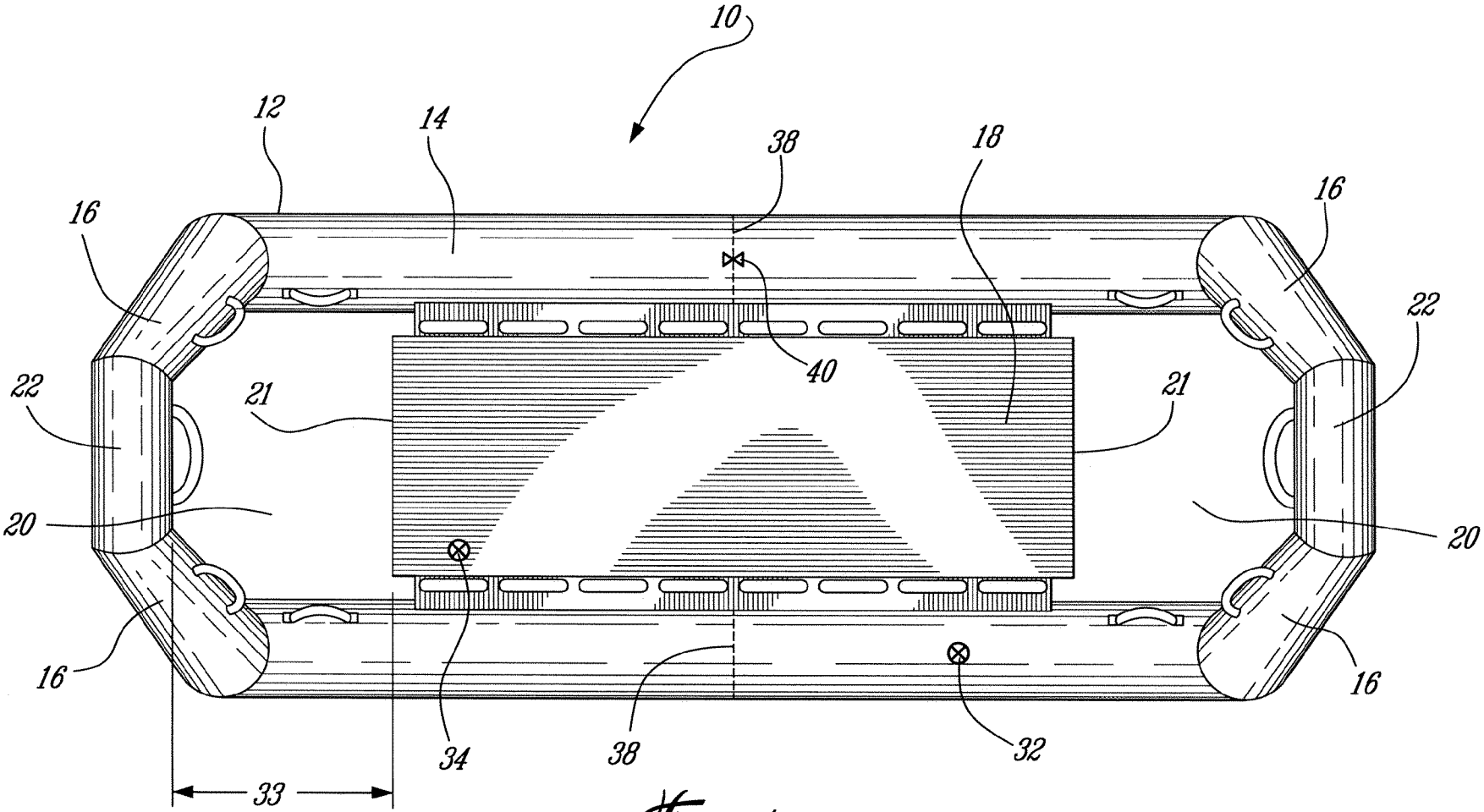
FIG. 1 is a top view of a rescue water craft in accordance with an embodiment of the present invention.

FIG. 1, which is now referred to, illustrates the rescue water craft 10. The rescue water craft 10 is made of an elongated closed-loop tubular structure 12. This tubular structure 12 has a mid portion 14 and two end portions 16. The mid portion 14 is defined as being the straight portion of the rescue water craft 10 joining both end portions 16. The two end portions are commonly known as the bow and stern of the water craft although, in this type of water craft, both end portions 16 may be symmetrical and therefore it is impossible to distinguish the bow from the stern.

The rescue water craft 10 is also equipped with a floor 18 partially running along the length of the mid portion 14 and spanning laterally from one side of the tubular structure 12 to its other side. The floor 18 is thereby encircled by the tubular structure 12. The floor 18 is interrupted such as to create two openings 20 defined as the open space in between each extremity 21 of the floor 18 and the tubular structure 12 of each end portion 16. Taken horizontally, or along the longitudinal axis of the mid portion 14, a major part of the openings 20 is located in the mid portion 14. Each of the two openings 20 may be used by rescuers to pull a distressed person from water and lay the person on the floor 18. Once on the floor 18, it is easier for the rescuer to provide first aid to the distressed person.

Figure 2:
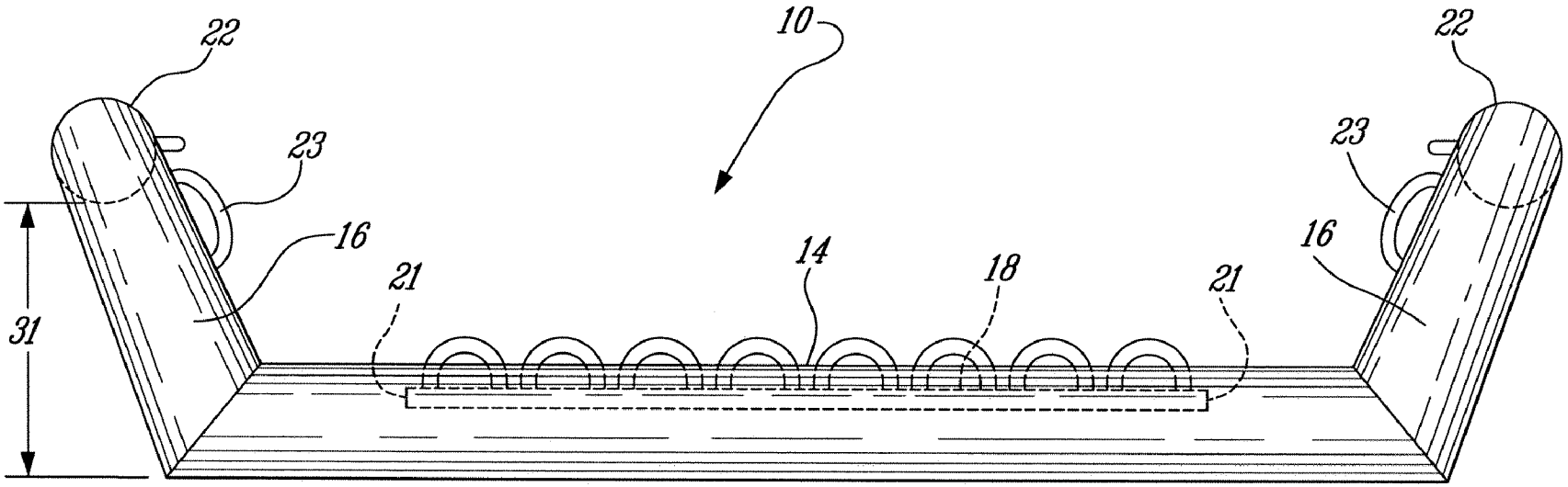
FIG. 2 is a side view of the rescue water craft of FIG. 1
Figure 3:
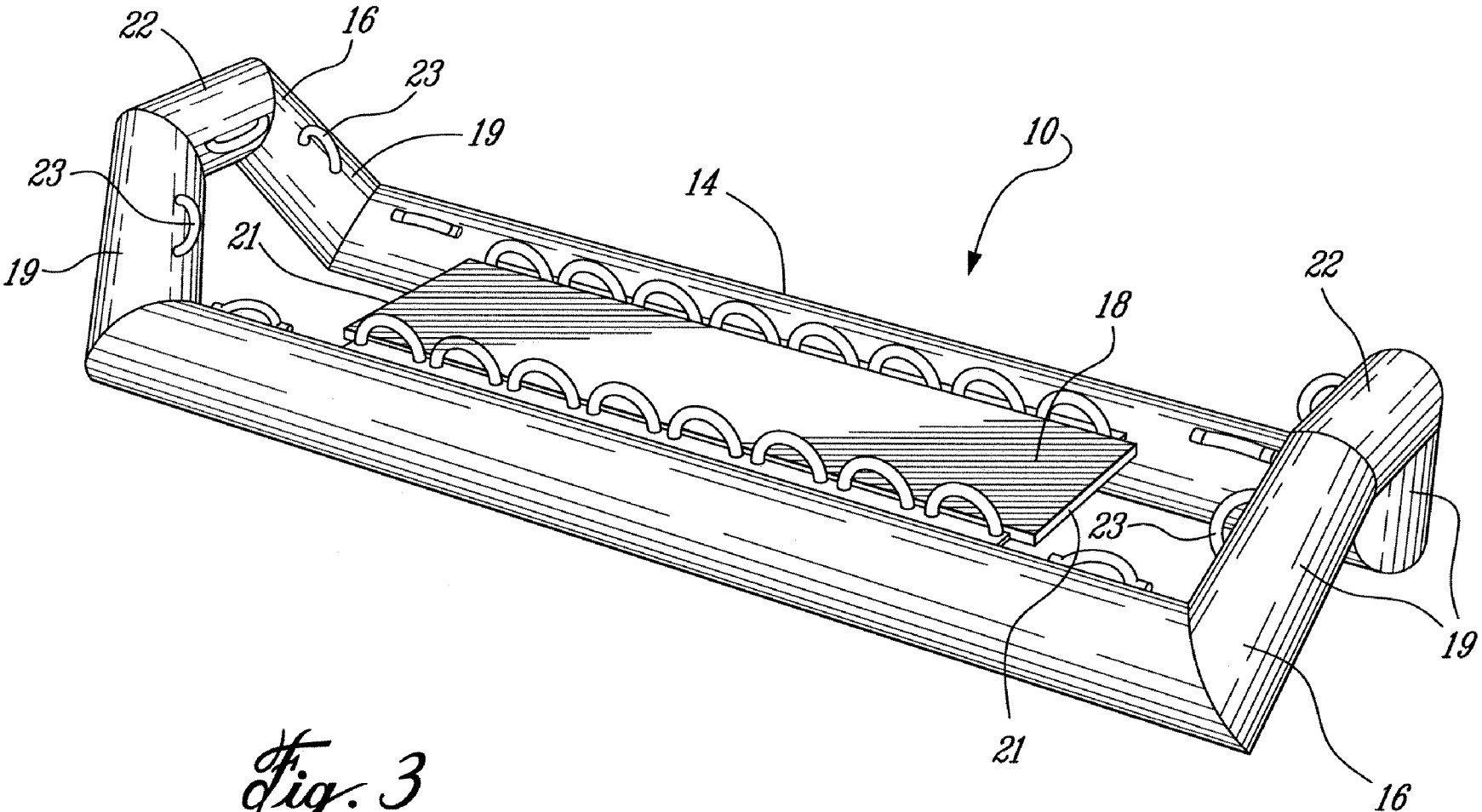
FIG. 3 is a perspective view of the rescue water craft of FIG. 1.

As best shown in FIG. 2 and FIG. 3, which are now concurrently referred to, both end portions 16 rise upwardly and outwardly from the mid portion 14 at an angle comprised between 70 and 85 degrees. A narrower range of between 75 and 80 degrees may also be used. Both end portions 16 may have their sides 19 tapered towards their top portion 22. Hence, the top portions 22 have a smaller diameter than the diameter of the mid portion 14. The sides 19 of the end portions 16 are equipped with handles 23 to provide grip to the rescuers when they adopt a stand-up position, as will be discussed below.

Such a rescue water craft geometry provides many advantages. First, for a given overall height of the rescue water craft 10, the tapered shape of the end portions 16 provides added clearance in the opening 20. Furthermore, because they rise at a steep angle, the end portions 16 do not extend horizontally as much as with a shallower angle, thereby providing a shorter water craft that is more maneuverable. This is especially useful when rescuing a person close to waterfalls. Moreover, the rescuer may adopt a better searching position by standing-up and resting against one of the end portions 16. If need be, the rescuer may secure himself by grabbing the handles 23. Adopting this searching position improves the rescuer's perspective of the environment and consequently, his chances of spotting the distressed person. This is an important improvement over similar existing rescue water crafts where it is not possible to stand-up. Likewise, it has been found that the view from a rescuer's perspective thorough the opening is better, which allows for an easier approach and positioning of the rescue water craft 10 around the floating distressed person.

Figure 4:
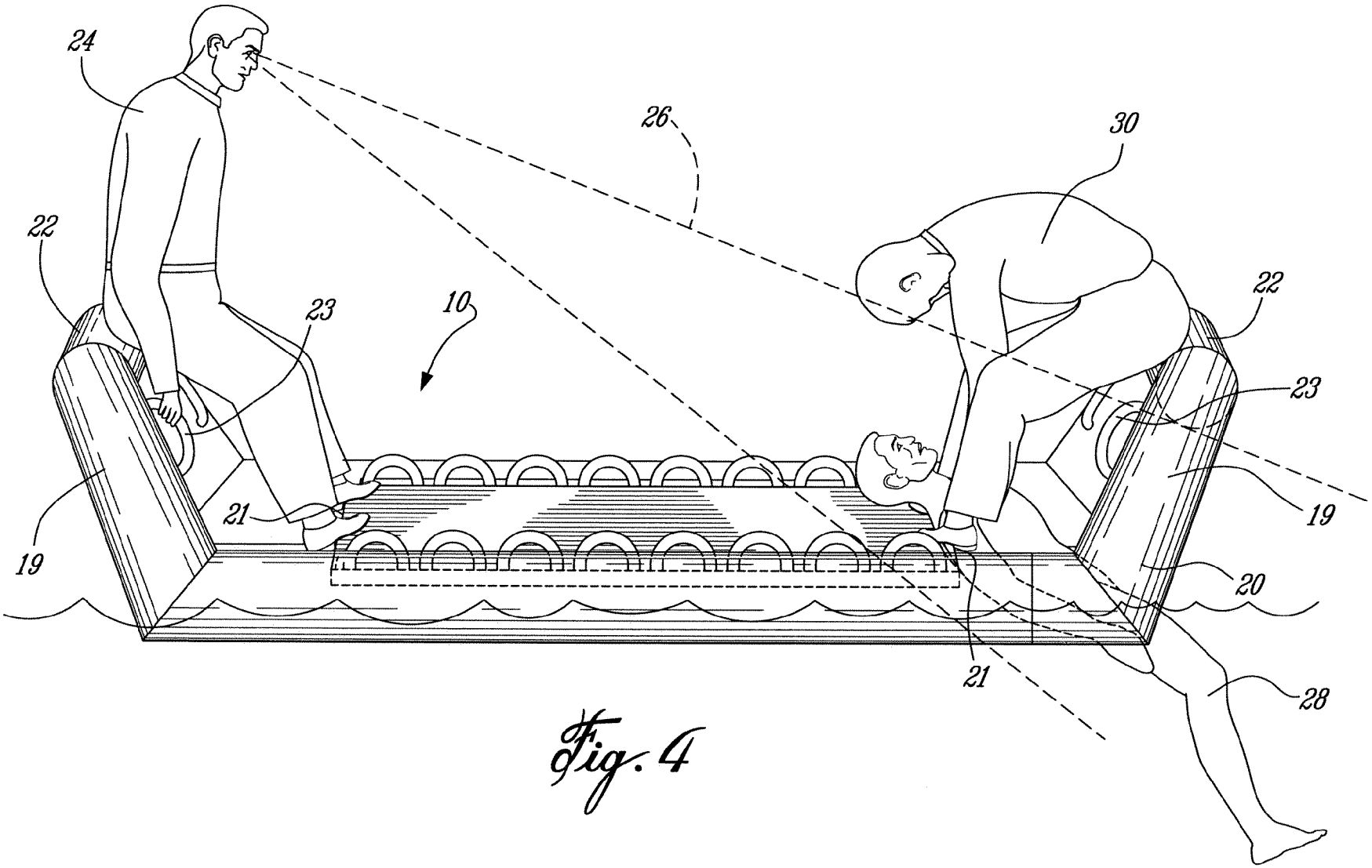
FIG. 4 is a side view, in use, of the rescue water craft of FIG. 1.

FIG. 4, now concurrently referred to, depicts a first rescuer 24, his lower back resting against one end portion 16, similarly to the position someone may adopt in a raft going down a river, to spot rocks and other obstacles. It is possible to adopt this position because of the steep angle of the end portions 16. To steady himself, the first rescuer 24 grabs the handles 23 and places his feet against the floor 18, or against the floor extremity 21. As can be seen, the specific geometry of the end portions 16 allows the first rescuer 24 to stand up and adopt a high searching position, thereby greatly enhancing his perspective of the environment, and enlarging his field of view. This is particularly useful when the water surface is rough and there are waves behind which the distressed person could be hidden, such as in a swift river. Similarly, this same geometry provides a good field of view 26 of the distressed person 28 through the opening 20. In addition, such geometry of the end portions 16 brings closer the top portion 22 from the nearest extremity of the floor 18 such that a second rescuer 30 may adopt a new rescuing position and method of rescuing. Indeed, because the top portion 22 is closer to the extremity 21 of the floor 18, it is possible for the second rescuer 30 to rest his lower back against the top portion 22 and have his feet contact the floor 18, such that he can assume the new rescuing position. Adopting this position, the second rescuer 30 then bends his back and extends his arms to reach for and grab the distressed person 28. The second rescuer 30 then uses the force of his legs, back and arms to pull the distressed person 28 out of the water and lay the distressed person 28 on the floor 18. This is very useful, for example, in cold water conditions when the distressed person 28 wears thick clothing, such as a snowmobile suit and even a helmet and therefore weighs much more than its dry weight.

Although other dimensions may provide adequate results, it has been found that providing at least 20 inches of vertical opening clearance 31, best shown in FIG. 2 and defined as a vertical distance between a lowest part of the mid portion 14 and a bottom of the top portion 22, allowed rescuing the distressed person 28 without having to push his head down to clear the top portion 22. Moreover, positioning the closest extremity 21 of the floor 18 such as to create a longitudinal opening clearance 33, best shown in FIG. 1, of approximately 28 inches allowed the second rescuer 30 to adopt the new rescuing position while still maintaining a sufficiently large opening 22. The person skilled in the art will appreciate that this dimension may somewhat vary while still providing adequate performance.

It is possible to make the tubular structure 12 inflatable. Similarly, the floor 18 may also be inflatable. This is indeed very convenient for rescue teams since the rescue water craft 10 may be compactly stored in a bag and deployed in no time once arrived on a rescue site. As best shown in FIG. 1, now referred to, the rescue water craft 10 may be equipped with one or more inflation valves 32, 34, respectively located on the tubular structure 12 and the floor 18. Optionally, the tubular structure 12 and the floor 18 may be in fluid communication so that the rescue water craft 10 may be equipped with a single inflation valve 32. This is convenient as the rescue water craft 10 may be rapidly inflated using, for example, compressed air.

For safety reasons, the tubular structure 12 may be provided with at least two internal chambers 36, divided by internal walls 38. These two internal chamber 36 may be in fluid communication with each other through a check valve 40 located in one of the internal walls 38. The check valve 40 must be oriented correctly such that the air may flow from the inflation valve 32 located in one internal chamber 36 to the other internal chamber 36.

The tubular structure 12 and the floor 18 may be made of a variety of materials such as aluminum, in the case the rescue water craft 10 is not inflatable, or Hypalon™ in the case the rescue water craft 10 is inflatable. Hypalon™ has been found to provide very good performance and provides a very rigid structure once inflated to an adequate pressure of approximately 3 psi.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description.

I claim:

1. A rescue water craft for use by a rescuer to rescue a distressed person in water, said rescue water craft comprising:

an elongated closed-loop tubular structure having a mid portion and an end portion, said end portion corresponding to a bow and a stern of said water craft, said end portion rising upwardly and outwardly from said mid portion at an angle of at least 70 degrees, said end portion comprising a top portion; and a floor partially running along said mid portion, said floor being attached to and encircled by said tubular structure, said end portion defining an opening between said tubular structure and said floor, wherein said opening is longitudinally mainly located within said mid portion;

wherein said top portion together with said floor are adapted to receive respectively said rescuer lower back and said rescuer feet.

2. The rescue water craft of claim 1 wherein said end portions has two sides, each of said sides further comprising a handle.

3. The rescue water craft of claim 2 wherein said sides are tapered towards the top portion of said end portions.

4. The rescue water craft of claim 3 wherein said end portion rises upwardly and outwardly from said mid portion at an angle comprised between 75 and 80 degrees.

5. The rescue water craft of claim 4 wherein said opening has a vertical opening clearance of at least 20 inches, said vertical opening clearance being defined as a vertical distance between a lowest part of said mid portion and a bottom of said top portion.

6. The rescue water craft of claim 5 wherein said opening has a longitudinal opening clearance of substantially 28 inches.

7. The rescue water craft of claim 1 wherein said tubular structure is inflatable, said tubular structure comprising a structure inflation valve.

8. The rescue water craft of claim 7 wherein said floor is inflatable, said floor comprising a floor inflation valve.

9. The rescue water craft of claim 8 wherein said floor is in fluid communication with said tubular structure.

10. The rescue water craft of claim 1 wherein said tubular structure comprises at least two internal chambers, said two internal chamber being in fluid communication with each other.

11. The rescue water craft of claim 10 wherein said two internal chambers are separated by a check valve.

* * * * *